US007743574B2

(12) United States Patent
Tufts et al.

(10) Patent No.: US 7,743,574 B2
(45) Date of Patent: Jun. 29, 2010

(54) SYSTEM OF BLOCKS FOR USE IN FORMING A FREE STANDING WALL

(75) Inventors: Paul R. Tufts, Eagan, MN (US); Gene R. Karjala, Chaska, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 985 days.

(21) Appl. No.: 11/056,203

(22) Filed: Feb. 11, 2005

(65) Prior Publication Data

US 2006/0179777 A1 Aug. 17, 2006

(51) Int. Cl.
*E04C 3/30* (2006.01)

(52) U.S. Cl. ..... 52/561; 52/574; 52/575; 52/612; 52/604; 405/262; 405/284; 256/19; D25/113

(58) Field of Classification Search ..... 52/102, 52/314, 503, 561, 562, 568, 569, 570, 574, 52/575, 596, 600, 603, 604, 612, 721.1, 726.3, 52/730.1, 736.1, 270, 272, 281, 282.1, 504, 52/415, 423, FOR. 103, FOR. 118, FOR. 126, 52/FOR. 152, 282.2; 405/262, 272, 284, 405/286; 256/19; 47/33; D25/5, 113
See application file for complete search history.

(56) References Cited

U.S. PATENT DOCUMENTS

| | | | | | |
|---|---|---|---|---|---|
| 16,486 | A | * | 1/1857 | Johnson | 256/19 |
| 1,195,670 | A | * | 8/1916 | Girlot | 52/570 |
| 1,412,926 | A | * | 4/1922 | Dardano | 52/562 |
| 1,416,919 | A | * | 5/1922 | Wickson | 52/611 |
| 1,418,464 | A | * | 6/1922 | Praetorius | 52/604 |
| 1,419,623 | A | * | 6/1922 | Fessenden | 52/591.2 |
| 1,453,837 | A | | 5/1923 | Heath | |
| 1,487,354 | A | * | 3/1924 | O'Rourke | 405/152 |
| 1,510,473 | A | * | 10/1924 | Frewen | 52/570 |
| 1,557,274 | A | * | 10/1925 | Smith et al. | 52/270 |
| 1,744,171 | A | | 1/1930 | Lane | |
| 1,795,451 | A | * | 3/1931 | Sharpe | 52/314 |
| 1,829,435 | A | * | 10/1931 | Barnhart | 52/125.3 |

(Continued)

FOREIGN PATENT DOCUMENTS

DE 907 690 7/1949

(Continued)

OTHER PUBLICATIONS

Anchor Retaining Wall Products Catalog (8 pages).

(Continued)

*Primary Examiner*—Robert J Canfield
*Assistant Examiner*—Matthew Gitlin
(74) *Attorney, Agent, or Firm*—Merchant & Gould P.C.

(57) ABSTRACT

A system of blocks for building a free standing wall. The system includes at least one size of wall block and a generally rectangular column block. The height and depth of the column block are the same as those of the wall block and the length of the column block is twice its depth. The exposed surfaces of the blocks in the free standing wall are textured to a greater extent than the other surfaces. The blocks are used to form a wall with a rectangular column, where the wall is tied into the column to enhance the stability of the wall.

14 Claims, 4 Drawing Sheets

U.S. PATENT DOCUMENTS 1,970,209 A * 8/1934 Weaton ..... 432/250
2,016,382 A * 10/1935 McBurney ..... 52/570
2,057,018 A * 10/1936 Dillon ..... 256/19
2,143,616 A * 1/1939 Adler ..... 52/423
2,151,468 A 3/1939 Henderson
2,158,943 A * 5/1939 Mamula ..... 52/89
2,304,196 A * 12/1942 Oakley ..... 52/608
2,397,119 A * 3/1946 Bohn ..... 52/279
RE22,913 E * 9/1947 Wells ..... 52/505
2,624,193 A * 1/1953 Larson ..... 52/503
D174,787 S * 5/1955 Larson ..... D25/44
3,172,267 A * 3/1965 Fisher ..... 405/107
3,298,668 A * 1/1967 Schueren ..... 256/19
3,355,849 A * 12/1967 Hancock ..... 52/396.08
3,512,759 A * 5/1970 Resler ..... 256/19
4,069,633 A 1/1978 Cooper et al.
D270,374 S * 8/1983 Pennington et al. ..... D25/5
4,726,567 A * 2/1988 Greenberg ..... 256/19
4,865,781 A * 9/1989 Jennings ..... 264/35
4,897,955 A * 2/1990 Winsor ..... 47/33
4,952,097 A * 8/1990 Kulchin ..... 405/262
5,161,918 A * 11/1992 Hodel ..... 405/286
5,168,678 A * 12/1992 Scott et al. ..... 52/102
D340,169 S * 10/1993 Scott et al. ..... D8/1
5,252,017 A * 10/1993 Hodel ..... 411/446
5,294,216 A * 3/1994 Sievert ..... 405/286
5,315,802 A 5/1994 Hart
D348,592 S * 7/1994 Scott et al. ..... D8/1
5,378,088 A * 1/1995 Foehrkolb ..... 405/284
5,404,685 A * 4/1995 Collins ..... 52/309.7
5,622,456 A * 4/1997 Risi et al. ..... 405/284
5,623,797 A * 4/1997 Gravier et al. ..... 52/284
5,647,185 A 7/1997 Forlini
D396,302 S * 7/1998 Cziczeli ..... D25/58
5,791,827 A 8/1998 Arvai et al.
5,836,572 A * 11/1998 Sugiyama ..... 256/19
5,848,511 A * 12/1998 Scales ..... 52/606
6,070,379 A * 6/2000 Dean, Jr. ..... 52/309.1
6,115,983 A 9/2000 Poignard
6,149,352 A * 11/2000 MacDonald ..... 405/284
6,199,832 B1 * 3/2001 Morrow ..... 256/19
6,431,798 B1 8/2002 Magliocco
6,447,213 B1 * 9/2002 MacDonald ..... 405/284
6,527,483 B1 * 3/2003 Agee ..... 405/284
6,568,143 B2 * 5/2003 Coleman ..... 52/604
6,571,521 B1 * 6/2003 Ameigh ..... 52/295
6,637,981 B2 10/2003 MacDonald
6,651,401 B2 11/2003 Price et al.
6,912,823 B2 * 7/2005 MacDonald et al. ..... 52/574
6,948,282 B2 * 9/2005 Bott ..... 52/98
6,960,048 B2 * 11/2005 Blomquist et al. ..... 405/284
7,080,827 B1 * 7/2006 McCannon, Jr. ..... 256/19
7,244,079 B1 * 7/2007 Blomquist et al. ..... 405/284
D577,128 S * 9/2008 Pajitas ..... D25/113
2001/0054268 A1 12/2001 Coleman
2003/0002925 A1 * 1/2003 Blomquist et al. ..... 405/284
2003/0009970 A1 1/2003 MacDonald et al.
2003/0029114 A1 * 2/2003 MacDonald et al. ..... 52/562
2003/0074856 A1 * 4/2003 Hammer ..... 52/604
2003/0089068 A1 5/2003 Ameigh
2003/0126821 A1 * 7/2003 Scherer et al. ..... 52/604
2003/0150184 A1 * 8/2003 Turgeon-Schramm et al. . 52/561
2004/0237445 A1 * 12/2004 Kliethermes ..... 52/575
2005/0086892 A1 * 4/2005 Dean, Jr. ..... 52/604
2005/0252146 A1 * 11/2005 MacDonald et al. ..... 52/606
2006/0002769 A1 * 1/2006 Blomquist et al. ..... 405/284
2006/0110223 A1 * 5/2006 Dawson et al. ..... 405/286
2006/0117697 A1 * 6/2006 Adam ..... 52/596
2007/0062149 A1 * 3/2007 Scherer et al. ..... 52/596
2007/0163203 A1 * 7/2007 Price ..... 52/721.4
2007/0175115 A1 * 8/2007 Price ..... 52/169.12
2007/0234665 A1 * 10/2007 Price ..... 52/311.1
2007/0258776 A1 * 11/2007 Strand et al. ..... 405/284
2008/0095584 A1 * 4/2008 Strand et al. ..... 405/284
2008/0172970 A1 * 7/2008 MacDonald et al. ..... 52/574
2008/0256891 A1 * 10/2008 Raboine ..... 52/604
2008/0277561 A1 * 11/2008 MacDonald ..... 249/158

FOREIGN PATENT DOCUMENTS

DE 298 00 946 3/1998
FR 1 047 733 7/1953
FR 2 476 720 8/1981
GB 248234 3/1926
GB 420 677 12/1934
JP 05086684 A 6/1993

OTHER PUBLICATIONS

EP Henry Coventry Wall Plus product literature (2 pages).
EP Henry Coventry Wall and Coventry Wall Plus product literature printed from www.ephenry.com (12 pages).
EP Henry "Wall System Installation" (1 page).
EP Henry Idea Catalog 2001, pp. 28-29.
Allan Block building instructions, printed from http://www.allanblock.com/Courtyard/Homeownerframe.htm (2 pages).
Keystone Country Manor Design and Construction Manual (20 pages).
Home Depot EP Henry Idea Book for Hardscaping (23 pages).
European Search Report, Apr. 23, 2008.

* cited by examiner

20

SYSTEM OF BLOCKS FOR USE IN FORMING A FREE STANDING WALL

FIELD OF THE INVENTION

The invention relates generally to concrete blocks and walls formed from concrete blocks. More specifically, the invention relates to a system of blocks for forming free standing walls. Even more specifically, the invention relates to a system of blocks for forming free standing walls that include a column.

BACKGROUND OF THE INVENTION

Concrete blocks have been a basic building material for many years Concrete blocks have been designed for use in many applications, including concrete masonry blocks used in the construction of foundations for residential and commercial buildings, as well as in constructing the interior and exterior walls of such buildings, and concrete retaining wall blocks used to construct retaining walls. Concrete masonry blocks are typically laid up in courses with mortar being used to secure the blocks to one another, while concrete retaining wall blocks are typically dry stacked (i.e. no mortar is used) in ascending courses.

Concrete blocks may also be used to construct free standing walls. A free standing wall is a wall that is open on each side of the wall.

Free standing walls may be an important architectural component of both residential and commercial buildings. For example, a free standing wall can be constructed around the perimeter of a patio to separate the patio from another area. As a further example, a free standing wall may be built at the end of a driveway to a residence so as to form an entrance marker. These free standing walls should be easy to construct, so that homeowners or others without special training can install them. Free standing walls should also be capable of being constructed with a curved form, so as to fit and function appropriately in their environment. Free standing walls should also be stable and resistant to falling over. Further, free standing walls should be attractive.

A free standing wall may also include a column to provide additional attractiveness, to provide an attachment point for related devices (such as lights, signs, gates, etc.), and to provide additional stability to the free standing wall.

There is a continuing need for a system of blocks that can be used to form attractive and functional free standing walls. The system of blocks should readily assemble into a free standing wall that is strong and secure, as well as attractive. The system should also readily allow columns to be incorporated into the free standing wall.

SUMMARY OF THE INVENTION

The invention relates to a system of concrete blocks for constructing a free standing wall. The blocks of the system permit construction of a strong, secure, and stable wall that is aesthetically pleasing and easy to construct. The wall may be curved and may include one or more columns.

The system includes a plurality of generally trapezoidal-shaped wall blocks and generally rectangular column blocks. The generally trapezoidal-shaped wall blocks are textured or "rock-faced" on the front and back surfaces, and the rectangular column blocks are textured or "rock-faced" on a side surface and an end surface. Further, the length of the rectangular column block is twice the depth of the wall and column blocks to allow for construction of a column that is tied into the wall.

BRIEF DESCRIPTION OF THE PREFERRED EMBODIMENT

The invention relates to concrete blocks that can be used to construct a free standing wall. The system of blocks is configured to allow a free standing wall to be readily constructed without the use of mortar, where the wall can be curved and can include a column tied into the wall for additional stability and attractiveness.

The system of blocks comprises at least one generally trapezoidal wall block and at least one generally rectangular column block described in detail below. Preferably, the system of blocks comprises two generally trapezoidal wall blocks and one generally rectangular column block. Most preferably, the system of blocks comprises at least three generally trapezoidal wall blocks and one generally rectangular column block.

Figure 1:
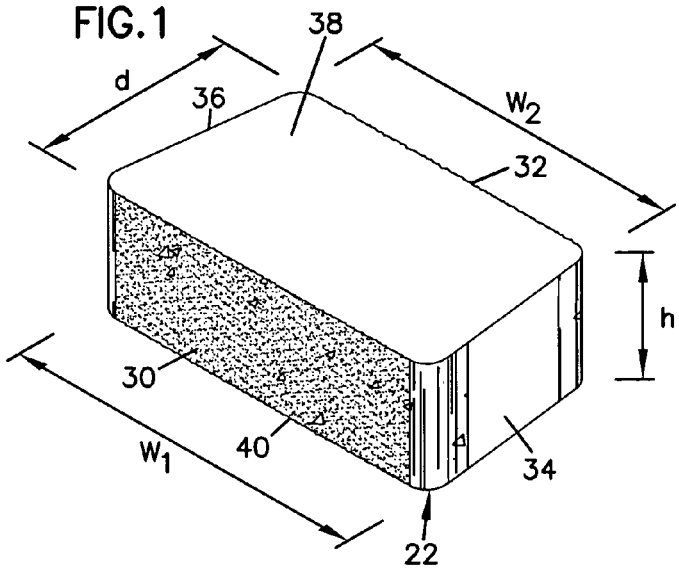
FIG. 1 is an isometric view of a first wall block of the system of blocks.
Figure 2:
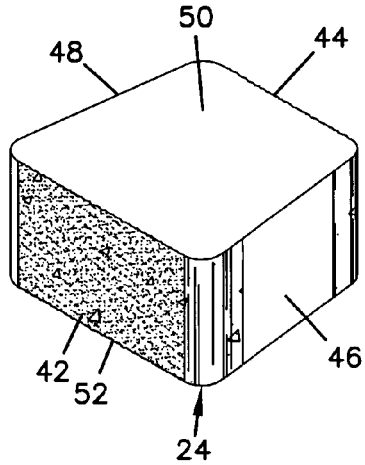
FIG. 2 is an isometric view of a second wall block of the system of blocks.
Figure 3:
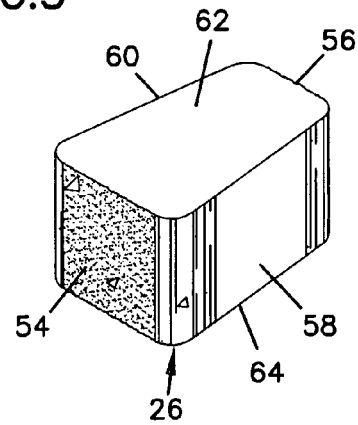
FIG. 3 is an isometric view of a third wall block of the system of blocks.
Figure 4:
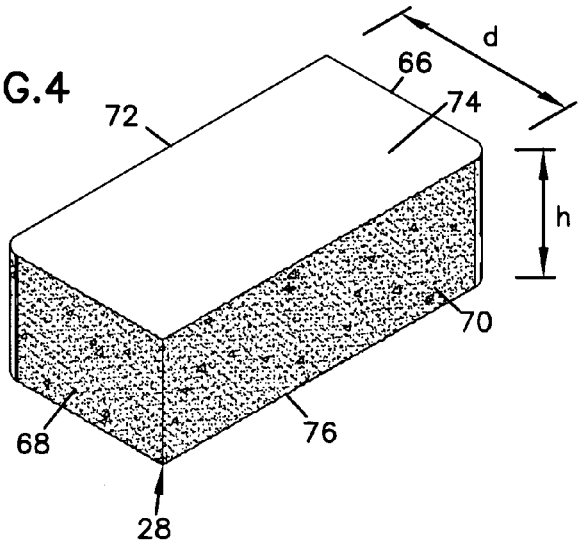
FIG. 4 is an isometric view of a column block of the system of blocks.

Attention is now directed to the figures, where like parts are identified with like numerals. FIG. 1 illustrates a first generally trapezoidal wall block 22. FIG. 2 illustrates a second generally trapezoidal wall block 24. FIG. 3 illustrates a third generally trapezoidal wall block 26. FIG. 4 illustrates a generally rectangular column block 28. Blocks 22, 24, 26, and 28 together comprise a block system 20.

First trapezoidal wall block 22 comprises a pair of generally parallel side surfaces 30, 32; a pair of generally non-parallel side surfaces 34, 36 extending between the side surfaces 30, 32; a top surface 38; and a bottom surface 40. Similarly, second trapezoidal wall block 24 comprises a pair of generally parallel side surfaces 42, 44; a pair of generally non-parallel side surfaces 46, 48; a top surface 50; and a bottom surface 52. Similarly, third trapezoidal wall block 26 comprises a pair of generally parallel side surfaces 54, 56; a pair of generally non-parallel side surfaces 58, 60; a top surface 62; and a bottom surface 64.

Rectangular column block 28 comprises a pair of generally parallel side surfaces 66, 68 having generally equal lengths; a pair of generally parallel side surfaces 70, 72 having generally equal lengths that are twice the length of the surfaces 66, 68; a top surface 74; and a bottom surface 76.

First trapezoidal wall block 22, second trapezoidal wall block 24, third trapezoidal wall block 26, and rectangular column block 28 each comprise certain common dimensional features so that each block is compatible for use together in block system 20.

In particular, each block in the system defines a common depth d, defined as the distance between parallel side surfaces 30, 32 of first trapezoidal wall block 22, parallel side surfaces 42, 44 of second trapezoidal wall block 24, parallel side surfaces 54, 56 of third trapezoidal wall block 26, and parallel surfaces 70, 72 of rectangular column block 28. Similarly, each block in the system defines a common height h, defined as the distance between top surface 38 and bottom surface 40 of block 22, top surface 50 and bottom surface 52 of block 24, top surface 62 and bottom surface 64 of block 26, and top surface 74 and bottom surface 76 of block 28.

Figure 5:
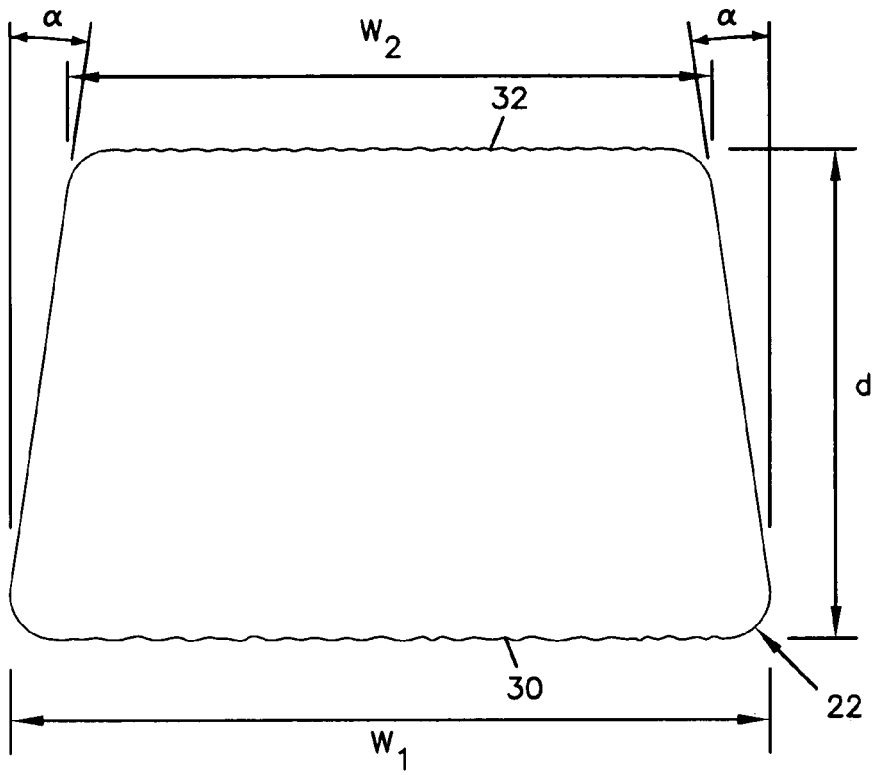
FIG. 5 is a bottom plan view of the wall block of FIG. 1.

Further, as shown in FIG. 5, the side surfaces 34, 36 of the first trapezoidal wall block 22 are tapered so that the side surfaces form an angle $\alpha$ with respect to an axis perpendicular to the parallel side surfaces of the block 22. The side surfaces of the second and third blocks 24, 26 are tapered in a similar manner. As a result, for each wall block, the widths $w_1$ and $w_2$ of the parallel side surfaces are unequal. Further, the widths $w_1$ and $w_2$ of the trapezoidal wall block 22, 24, 26 differ between the blocks 22, 24, 26, with block 22 having a greater width than block 24, which in turn has a greater width than block 26. For the rectangular column block, $w_1$ is equal to $w_2$ and they are equal to 2d.

For convenience, the first block 22 may be referred to hereinafter as a large wall block, the second wall block 24 may hereinafter be referred to as a medium wall block, and the third wall block 26 may hereinafter be referred to as a small wall block.

The illustrated blocks 22, 24, 26, 28 of the block system 20 are solid and, when laid up in a wall, they are preferably secured to one another using an adhesive between the courses of blocks. Therefore, the top and bottom surfaces of the blocks 22, 24, 26, 28 are devoid of pin receiving holes. However, the blocks could be secured to one another using pins, in which case pin receiving holes can be provided in the top and bottom surfaces of the blocks as needed.

The blocks comprising block system 20 are configured so that certain exposed surfaces of a free standing wall will be textured to provide an aesthetically attractive surface. A textured surface is one where an otherwise two-dimensional surface plane contains random or patterned variability so that the surface actually comprises three dimensions. The greater this variability, the rougher the surface, and the lower this variability, the smoother the surface.

In block system 20, the generally parallel side surfaces 30, 32 of first wall block 22; surfaces 42, 44 of second wall block 24; surfaces 54, 56 of third wall block 26; and surfaces 66, 70 of column block 28 are textured to be substantially rougher than the untextured surfaces of each block. The remaining block surfaces (surfaces 34, 36, 38, 40 of wall block 22; surfaces 46, 48, 50, 52 of wall block 24; surfaces 58, 60, 62, 64 of wall block 26; and surfaces 68, 72, 74, 76 of block 28) are substantially untextured. The textured surfaces may be formed by a number of means, for example by splitting. An example of a splitting method that may be used to form textured block surfaces is disclosed in commonly-assigned U.S. Pat. No. 6,321,740, entitled Block Splitter Assembly, which is hereby incorporated by reference in its entirety. Any other means of producing textured surfaces may also be used.

Figure 6:
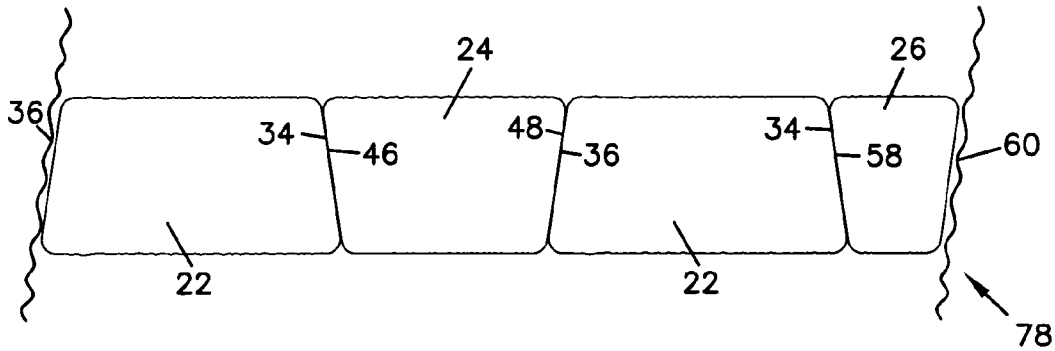
FIG. 6 is a top plan view of a portion of one course of a free standing wall formed from the wall blocks.

An example of a method of constructing a substantially straight free standing wall 78 from the wall blocks 22, 24, 26 is shown in FIG. 6. The trapezoidal wall blocks are arranged in a first course with alternating orientations of the non-parallel side surfaces of the wall blocks. Any combination of large wall block 22, medium wall block 24, and small wall block 26 can be used. For example, the wall 78 can include a first large wall block 22, a medium wall block 24 positioned adjacent the block 22 such that surface 46 of medium wall block 24 abuts against surface 34 of large wall block 22, a second large wall block 22 so that surface 36 abuts surface 48 of the medium wall block 24, and a small wall block 26 with surface 58 of the wall block 26 abutting against surface 34 of the second large wall block 22. Alternatively, the wall 78 could be constructed entirely from one of the wall block sizes 22, 24, 26.

One or more additional courses of blocks are then stacked on top of the first course. Preferably, a layer or bead of adhesive is applied to the top surfaces of the blocks to secure the blocks in one course to the blocks in the next course of blocks. For example, adhesive can be applied to the exposed top surfaces of the blocks in the first course before laying the second course. Securing the courses to one another provides additional stability to the wall.

Figure 7:
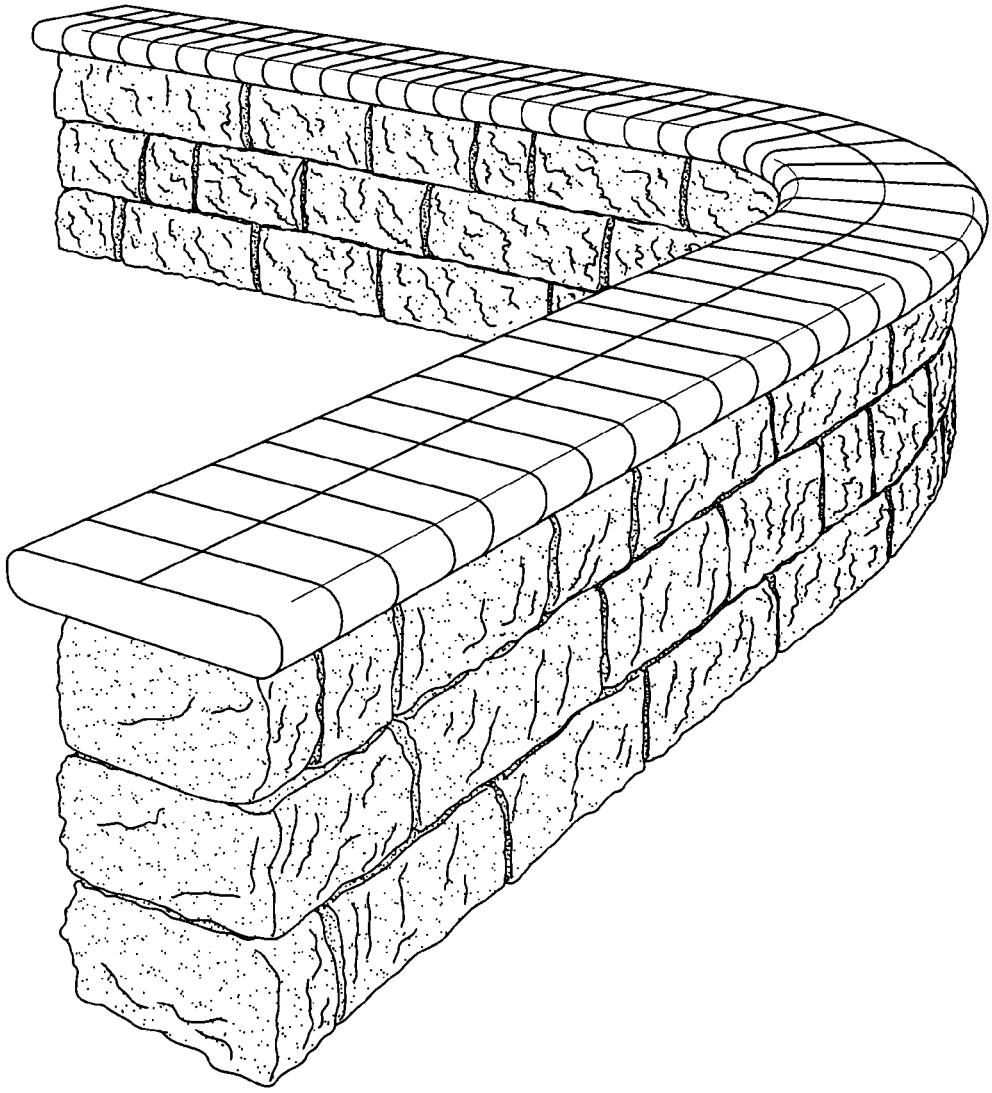
FIG. 7 is a perspective view of a free standing wall constructed from the system of blocks.

FIG. 7 shows a completed free standing wall. The wall in FIG. 7 includes a curved section that is constructed by arranging the trapezoidal wall blocks 22, 24, 26 so that the shorter of the generally parallel side surfaces (i.e., surface 32 of block 22, surface 44 of block 24, and surface 56 of block 26) forms a portion of the inner radius of the curved section.

Figure 8A:
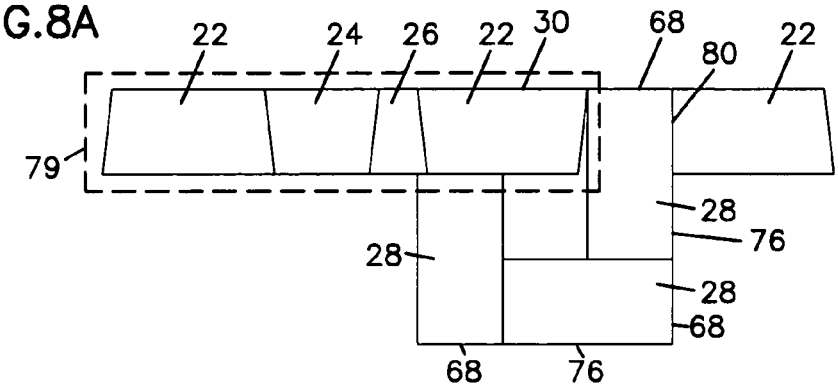
FIG. 8A is a top plan view of a portion of one course of a wall formed from the system of blocks, where the wall includes a column in the form of a pilaster.
Figure 8B:
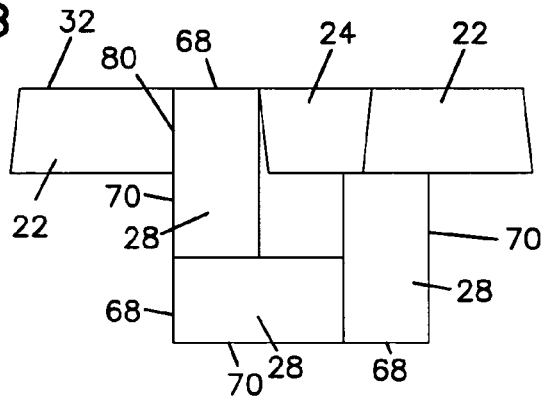
FIG. 8B is a top plan view of a second course of the wall portion of FIG. 8A.

The free standing wall also includes a column. A column is a vertically-constructed block structure that is generally rectangular. A pilaster is one specific type of column that projects from one side surface of the wall. FIGS. 8A and 8B illustrate how to construct a free standing wall with the block system 20 where the wall includes a column in the form of a pilaster.

With reference initially to FIG. 8A, a first course is laid, where the first course includes a wall segment 79 that is similar to the wall segment 78 in FIG. 6. Next, proceeding in a clockwise direction in FIG. 8A, the pilaster is formed by laying a first rectangular column block 28 at approximately a right angle to the last wall block in wall segment 79, such that surface 68 of column block 28 forms an approximately planar surface with surface 30 of wall block 22. Then a second rectangular column block 28 is laid at approximately a right angle to the first rectangular column block 28, such that surface 68 of the second rectangular column block 28 forms an approximately planar surface with surface 76 of the first rectangular column block 28. Next, a third rectangular column block 28 is laid at approximately a right angle to the second rectangular column block 28, such that the surface 68 of the third rectangular block 28 forms an approximately planar surface with surface 76 of the second rectangular column block 28.

Finally, to complete the first course illustrated in FIG. 8A, a large wall block 22 (or alternatively a medium wall block 24 or a small wall block 26) is cut to form a substantially flat surface 80, and the block is laid so that the substantially flat surface 80 abuts face 76 of the first rectangular block 28, in a direction generally coplanar with wall segment 78.

Next, with reference to FIG. 8B, a second course is built on top of the first course. The second course includes a large wall block 22 (or alternatively a medium wall block 24 or a short wall block 26) that has been cut to form a substantially flat surface 80, and that has been laid on top of first course wall segment 78 so that surface 80 is generally coplanar with surface 70 of the third rectangular column block 28 of the first course. Next, proceeding in a counterclockwise direction around the pilaster, a first rectangular column block 28 is laid on top of the first course, so that surface 70 abuts surface 80 of the cut block 22, and the surface 68 is generally coplanar with the surface 32 of the cut block 22. Then a second rectangular column block 28 is laid on top of the first course, so that surface 68 is generally coplanar with surface 70 of the first rectangular column block 28. Next, a third rectangular column block 28 is laid on top of the first course, so that surface 68 is generally coplanar with surface 70 of the second rectangular column block 28. Then a medium block 24 is laid on top of the first course, so that surface 46 is in contact with surface 72 of first rectangular column block 28 in the second course, and in a direction generally coplanar with wall segment 79. Next, a large wall block 22 is laid on top of the first course so that surface 36 of large wall block 22 abuts surface 48 of medium wall block 24.

The first and second courses are repeated until a wall is produced that is of the desired height. For example, the wall can include three courses as shown in FIG. 7. In the wall shown in FIGS. 8A and 8B, the wall segment is tied into the pilaster in each course (i.e. in each course, the wall blocks form a portion of the pilaster), thereby increasing the strength and stability of the free standing wall.

Figure 9A:
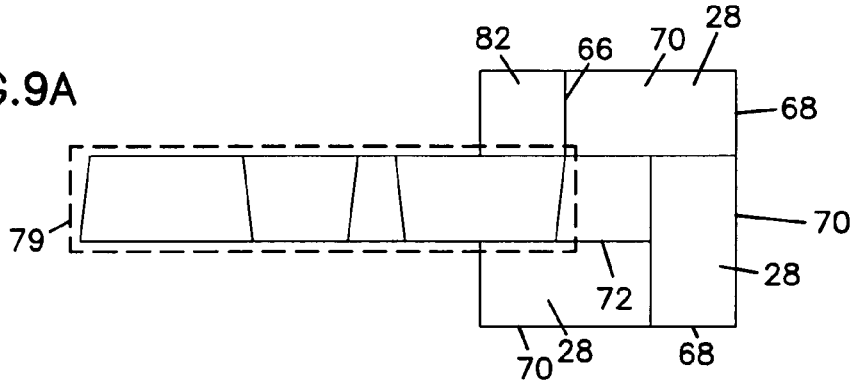
FIG. 9A is a top plan view of a portion of one course of a wall formed from the system of blocks, where the wall includes a column at the end of the wall.
Figure 9B:
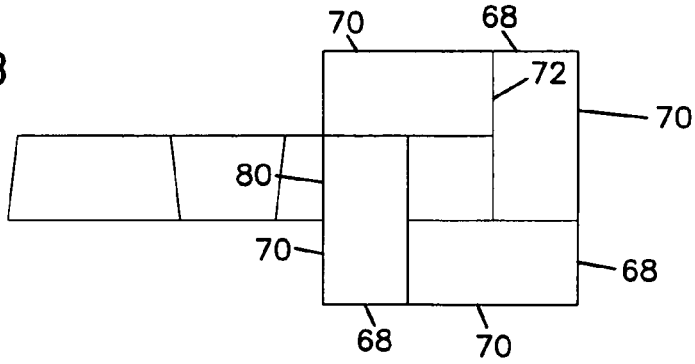
FIG. 9B is a top plan view of a second course of the wall portion of FIG. 9A.

The free standing wall may also include a column that is formed between the ends of the wall and that projects from both sides of the wall. In addition, the free standing wall may include a column that is formed at the end of the wall, as shown in FIGS. 9A and 9B. With reference initially to FIG. 9A, a wall segment 79 is constructed that is similar to the wall segment 79 in FIG. 8A. Next, proceeding in a counterclockwise direction, a first rectangular column block 28 is laid parallel to, but offset from, the last wall block in wall segment 79, so that surface 72 of rectangular column block 28 is generally coplanar with one surface of wall segment 79. A second rectangular column block 28 is laid at approximately a right angle to first rectangular column block 28, so that surface 68 of second rectangular column block 28 is generally coplanar with surface 70 of first rectangular column block 28. Then a third rectangular column block 28 is laid at approximately a right angle to second rectangular column block 28, so that surface 68 of third rectangular column block 28 is generally coplanar with surface 70 of second rectangular column block 28.

To complete the column, a rectangular column block 28 is cut in half to form a square block 82. The square block 82 is positioned against surface 66 of third rectangular column block 28 and the adjoining surface of wall segment 79.

A second course, illustrated in FIG. 9B, is then installed on top of the first course. Proceeding in a clockwise direction around the column, the second course includes a first rectangular block 28 placed directly over square block 82. Second, third, and fourth rectangular blocks 28 are laid at substantially right angles to each other, so that surfaces 68 are generally coplanar with surfaces 70 of each rectangular block 28. The second course also includes a small wall block 26 (or alternatively a large wall block 22 or a medium wall block 24) that is cut to form a flat surface 80, which is abutted against fourth rectangular block 28 in a direction generally coplanar with wall segment 78. Additional blocks are then added to the second course to create a wall segment of desired length.

In the column in FIGS. 9A and 9B, the wall is tied into the column in every other course (i.e. in the first course, a portion of a wall block forms a portion of the column), to increase the stability of the wall.

If additional courses for the free standing walls in FIGS. 8A, B and 9A, B are necessary, the blocks forming the column would repeat the layout of the column in the first and second courses. The layout of the wall blocks in subsequent courses can vary from the layout of the wall blocks in the first and second courses, as long as the tie-in of the wall and the column described in FIGS. 8A, B and 9A, B is achieved.

If the wall blocks are disposed at the end of the wall whereby one of the non-parallel side surfaces will be visible in the wall, the visible non-parallel side surface can also be textured or "rock-faced".

The invention claimed is:

1. A freestanding wall of concrete blocks comprising:

a first plurality of generally trapezoidal-shaped concrete wall blocks stacked atop one another into a plurality of courses to form a portion of the wall having a wall face, each of the wall blocks having two generally parallel side surfaces extending generally parallel to the length of the wall, two non-parallel side surfaces extending between the two generally parallel side surfaces, a top surface and a bottom surface, and each of the wall blocks having a depth "d" between the two generally parallel side surfaces and a height "h" between the top and bottom surfaces and the two generally parallel side surfaces have different distances between the two non-parallel side surfaces;

a plurality of generally rectangular concrete column blocks stacked atop one another into a plurality of courses to form a rectangular column of the wall, each column block having first and second generally parallel side surfaces having generally equal lengths, third and fourth generally parallel side surfaces having generally equal lengths, a top surface and a bottom surface, and each column block having a depth "d" between the first and second side surfaces, a height "h" between the top and bottom surfaces, and a length "2d", which is twice the depth "d", between the third and fourth side surfaces, part of the column forming a portion of the wall face, and part of the column extending away from the wall face, at least one rectangular column block in each course forming a portion of the wall face; and wherein for at least a plurality of courses of the wall, for every other course of the column the column comprises at least three of the column blocks and a portion of one of the wall blocks, which wall block bridges between the wall and the column and forms part of the wall and part of the column, and for the alternating course of the column a column block overlies the portion of the wall block that extends into and forms part of the column; and the wall and the column together has a depth in a direction away from the wall face formed by no more than two of the blocks selected from: the wall blocks, the column blocks, and combinations thereof.

2. The wall of claim 1, wherein at least one of the first and second side surfaces and at least one of the third and fourth side surfaces of each of the column blocks are textured to a greater degree than the top surface of each of the column blocks.

3. The wall of claim 1, wherein the generally parallel side surfaces of each wall block are textured to a greater degree than the top surfaces of the wall blocks.

4. The wall of claim 1, wherein, for each wall block and each of the column blocks, the top surface and the bottom surface are generally planar and parallel to each other, and are devoid of pin-receiving holes.

5. The wall of claim 1, further comprising a second plurality of generally trapezoidal-shaped concrete wall blocks which together with the first plurality of wall blocks form the portion of the wall, each of the wall blocks of the second plurality having two generally parallel side surfaces, two generally non-parallel side surfaces extending between the two parallel side surfaces, a top surface and a bottom surface, and each of the wall blocks of the second plurality having a depth "d" between the two generally parallel side surfaces, a height "h" between the top and bottom surfaces, and the blocks of the second plurality of wall blocks have distances between the non-parallel side surfaces different than that of the blocks of the first plurality of wall blocks.

6. The wall of claim 5, further comprising a third plurality of generally trapezoidal-shaped concrete wall blocks which together with the first and second plurality of wall blocks form the portion of the wall, each of the wall blocks of the third plurality having two generally parallel side surfaces, two non-parallel side surfaces extending between the two generally parallel side surfaces, a top surface and a bottom surface, and each of the wall blocks of the third plurality having a depth "d" between the two generally parallel side surfaces and a height "h" between the top and bottom surfaces and the blocks of the third plurality of wall blocks have distances between the non-parallel side surfaces different than that of the blocks of either the first or second plurality of wall blocks.

7. The wall of claim 1, wherein the column is disposed intermediate the ends of the wall.

8. The wall of claim 7, wherein for each course of a plurality of courses of the column, the column comprises three of the column blocks and a portion of one of the wall blocks.

9. The wall of claim 1, wherein the column is at an end of the wall.

10. The wall of claim 9, wherein for at least one course of the column, the column comprises three of the column blocks, one-half of a column block, and a portion of one of the wall blocks, and for at least one course of the column, the column comprises four of the column blocks.

11. The wall of claim 1, wherein the column blocks in each course of the column are arranged so that the third or fourth side surface of each block abuts against the first or second side surface of another column block or abuts against one of the two parallel side surfaces of a wall block.

12. A freestanding wall of concrete blocks comprising:

a first plurality of generally trapezoidal-shaped concrete wall blocks stacked atop one another into a plurality of courses to form a portion of the wall, each of the wall blocks having two generally parallel side surfaces extending generally parallel to the length of the wall, two non-parallel side surfaces extending between the two generally parallel side surfaces, a top surface and a bottom surface, and each of the wall blocks having a depth "d" between the two generally parallel side surfaces and a height "h" between the top and bottom surfaces and the two generally parallel side surfaces have different distances between the two non-parallel side surfaces;

a plurality of generally rectangular concrete column blocks stacked atop one another into a plurality of courses to form a rectangular column of the wall, each column block having first and second generally parallel side surfaces having generally equal lengths, third and fourth generally parallel side surfaces having generally equal lengths, a top surface and a bottom surface, and each column block having a depth "d" between the first and second side surfaces, a height "h" between the top and bottom surfaces, and a length "2d", which is twice of the depth "d", between the third and fourth side surfaces;

wherein for at least one course of the column, the column comprises three of the column blocks, one-half of a column block, and a portion of one of the wall blocks, which wall block bridges between the wall and the column and forms part of the wall and part of the column, and which wall block two parallel side surfaces each abut a different one of the column blocks; and for at least another course of the column adjacent to the at least one course, the column comprises four of the column blocks, in which one of the four column blocks overlies the portion of the wall block that extends into and forms part of the column.

13. The wall of claim 12, further comprising a second plurality of generally trapezoidal-shaped concrete wall blocks which together with the first plurality of wall blocks form the portion of the wall, each of the wall blocks of the second plurality having two generally parallel side surfaces, two generally non-parallel side surfaces extending between the two parallel side surfaces, a top surface and a bottom surface, and each of the wall blocks of the second plurality having a depth "d" between the two generally parallel side surfaces, a height "h" between the top and bottom surfaces, and the blocks of the second plurality of wall blocks have distances between the non-parallel side surfaces different than that of the blocks of the first plurality of wall blocks.

14. The wall of claim 13, further comprising a third plurality of generally trapezoidal-shaped concrete wall blocks which together with the first and second plurality of wall blocks form the portion of the wall, each of the wall blocks of the third plurality having two generally parallel side surfaces, two non-parallel side surfaces extending between the two generally parallel side surfaces, a top surface and a bottom surface, and each of the wall blocks of the third plurality having a depth "d" between the two generally parallel side surfaces and a height "h" between the top and bottom surfaces and the blocks of the third plurality of wall blocks have distances between the non-parallel side surfaces different than that of the blocks of either the first or second plurality of wall blocks.

* * * * *